US007041036B1

(12) United States Patent
Kuo

(10) Patent No.: US 7,041,036 B1
(45) Date of Patent: May 9, 2006

(54) EXERCISER HAVING ADJUSTABLE MECHANISM

(76) Inventor: Hai Pin Kuo, No. 15, Lane 833, Wen Hsien Road, Tainan 70459 (TW)

( * ) Notice: Subject to any disclaimer, the term of this patent is extended or adjusted under 35 U.S.C. 154(b) by 0 days.

(21) Appl. No.: 11/080,265

(22) Filed: Mar. 15, 2005

(51) Int. Cl.
*A63B 69/16* (2006.01)
*A63B 22/04* (2006.01)

(52) U.S. Cl. ..... 482/52; 482/51; 482/57

(58) Field of Classification Search ..... 482/51–53, 482/57, 70, 79–80
See application file for complete search history.

(56) References Cited

U.S. PATENT DOCUMENTS 5,779,599 A * 7/1998 Chen ..... 482/57
6,053,847 A * 4/2000 Stearns et al. ..... 482/51
6,080,086 A * 6/2000 Maresh et al. ..... 482/57
6,217,485 B1 * 4/2001 Maresh ..... 482/52
6,277,054 B1 8/2001 Kuo ..... 482/51
6,450,925 B1 * 9/2002 Kuo ..... 482/52
6,454,682 B1 * 9/2002 Kuo ..... 482/52
6,620,079 B1 9/2003 Kuo ..... 482/51
6,672,992 B1 * 1/2004 Lo et al. ..... 482/52
6,855,094 B1 * 2/2005 Maresh ..... 482/52

* cited by examiner

*Primary Examiner*—Stephen R. Crow
(74) *Attorney, Agent, or Firm*—Charles E. Baxley

(57) ABSTRACT

A stepping exerciser includes a pair of bars pivotally secured to a front portion of a base and each having an upper portion for being grasped by hands of users. A wheel and two cranks are rotatably supported on the base, two links coupled between the cranks and the bars, two beams pivotally secured to the bars and each having a front rod, two levers attached to the cranks, and two poles coupled between the beams and the levers to support foot supports. Two arms are coupled between the bars and the beams. An adjusting device may adjust the lower portions of the arms relative to the beams, to adjust a coupling relation between the beams and the bars and the arms, and between the poles and the levers, in order to adjust a moving stroke of the foot supports.

12 Claims, 7 Drawing Sheets

EXERCISER HAVING ADJUSTABLE MECHANISM

BACKGROUND OF THE INVENTION

1. Field of the Invention

The present invention relates to a stepping exerciser, and more particularly to a stepping exerciser having an adjustable mechanism for adjusting the moving stroke or the movement or the operation of the stepping exerciser.

2. Description of the Prior Art

Various kinds of typical stepping exercisers have been developed for conducting stepping or walking exercises or the like, and comprise a pair of foot supports movable along elliptical moving paths or elliptical strides, and may further comprise a brake device or the like for applying a resistive force or a braking force against the movement or operation or actuation of the stepping exercisers.

For example, U.S. Pat. No. 6,277,054 to Kuo discloses one of the typical stepping exercisers, and also comprises a pair of foot supports movable along elliptical moving paths or elliptical strides, and an adjusting mechanism or device for adjusting the moving stroke or the movement or the operation or the actuation of the stepping exerciser.

However, normally, the users should stop operating the stepping exercisers, before they may adjust the moving stroke or the operation of the stepping exercisers; i.e., the moving stroke of the stepping exerciser may not be adjusted while the exerciser is working or operating by the users.

For allowing the stepping exercisers to be easily adjusted or operated by the users, the applicant has developed another typical stepping exerciser which includes one or more switch buttons disposed or provided on top of a pair of handlebars, for allowing the users to adjust the moving stroke or the operation of the stepping exercisers with the switch buttons, while operating or actuating the stepping exerciser.

For example, U.S. Pat. No. 6,620,079 to Kuo discloses another typical stepping exerciser comprising a pair of foot supports movable along elliptical moving paths or elliptical strides, an adjusting mechanism or device for adjusting the moving stroke or the movement or the operation or the actuation of the stepping exerciser, and one or more switch buttons disposed or provided on top of a pair of handlebars, for allowing the users to adjust the moving stroke or the operation of the stepping exercisers while operating or actuating the stepping exerciser.

However, the adjustment of the moving stroke or the operation of the typical stepping exerciser is limited, and may not be effectively adjusted by the users.

The present invention has arisen to mitigate and/or obviate the afore-described disadvantages of the conventional stepping exercisers.

SUMMARY OF THE INVENTION

The primary objective of the present invention is to provide a stepping exerciser including an adjustable mechanism for adjusting the moving stroke of the stepping exerciser.

The other objective of the present invention is to provide a stepping exerciser including an adjustable mechanism for adjusting the moving stroke of the stepping exerciser while operating or actuating the stepping exerciser, without stopping the stepping exerciser.

In accordance with one aspect of the invention, there is provided a stepping exerciser comprising a base including a front portion having a post extended upwardly therefrom, and including a rear portion, a pair of bars pivotally secured to the post, and each including an upper portion having a handle provided thereon for being grasped by hands of users, and each including a lower portion, a wheel rotatably supported on the rear portion of the base, a pair of cranks coupled to the wheel and rotated in concert with the wheel, and each of the cranks including a free end, a pair of links pivotally coupled between the free ends of the cranks and the lower portions of the bars respectively, a pair of beams each including a middle portion pivotally secured to the lower portions of the bars respectively, and each including a front portion having a pivot rod slidably attached thereto, and each including a rear portion, a pair of poles pivotally coupled to the rear portions of the beams respectively, a pair of levers each including a rear portion pivotally secured to the free ends of the cranks respectively, and the levers being slidably coupled to the poles respectively, to allow the poles to be moved and slid relative to the levers respectively, a pair of foot supports disposed on either the poles or the levers respectively, for supporting users thereon, a pair of arms each including an upper portion pivotally secured to the bars respectively, and each including a lower portion pivotally secured to the front portions of the beams with the pivot rods respectively, to allow the lower portions of the arms to be moved and adjusted toward and away from the pivot rods respectively, and an adjusting device for adjusting the lower portions of the arms toward and away from the pivot rods respectively, to adjust a coupling relation between the beams and the bars and the arms, and between the poles and the levers, in order to adjust a moving stride or a moving stroke of the foot supports.

The adjusting device includes a follower coupled to each of the pivot rods, a motor disposed in each of the beams and coupled to a bolt which is threaded with the follower, to allow the bolt to be rotated and driven by the motor, and thus to allow the follower and the pivot rod to be moved and adjusted along the beams by the motors.

Each of the levers includes at least one pair of rollers disposed therein, for slidably coupling the poles thereto, and to allow the poles to be slidably coupled to the levers respectively. Each of the bars includes one end pivotally coupled to the lower portions of the bars with a pole respectively, and a moving device for moving the pole and the lower portions of the bars relative to the bars respectively.

The moving device includes a slide slidably engaged in each of the bars and having the pole secured thereto, for pivotally securing to the front portion of the link, a tube secured to each of the slides, a bolt threaded to each of the tubes, and a motor coupled to each of the bolts, to rotate and drive the bolts relative to the bars, and to adjust and to move the slides and the poles and the lower portions of the bars relative to the bars respectively.

Each of the bars includes a casing disposed therein, a gear is rotatably received in the casing and is secured to the bolt, and the motor is attached to the casing and coupled to the gear, for rotating the gear and the bolt. A switch is provided and disposed on top of a first bar of the pair of bars, to actuate the moving device.

The base includes a weight rotatably supported thereon. The base includes a brake device disposed thereon, for braking the weight. Another switch may further be provided and disposed on top of the other bar, to actuate the adjusting device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
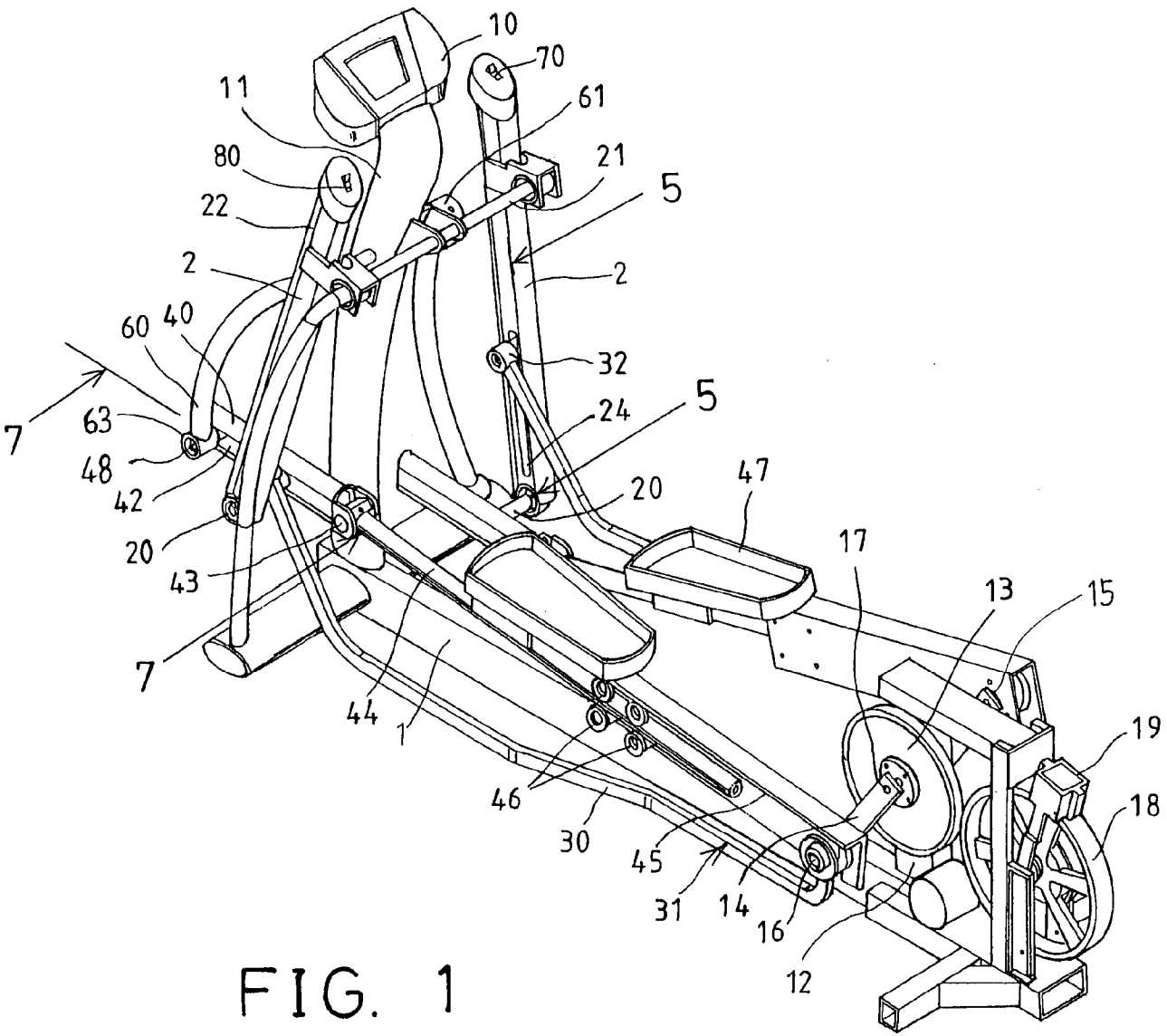
FIG. 1 is a perspective view of a stepping exerciser in accordance with the present invention.
Figure 2:
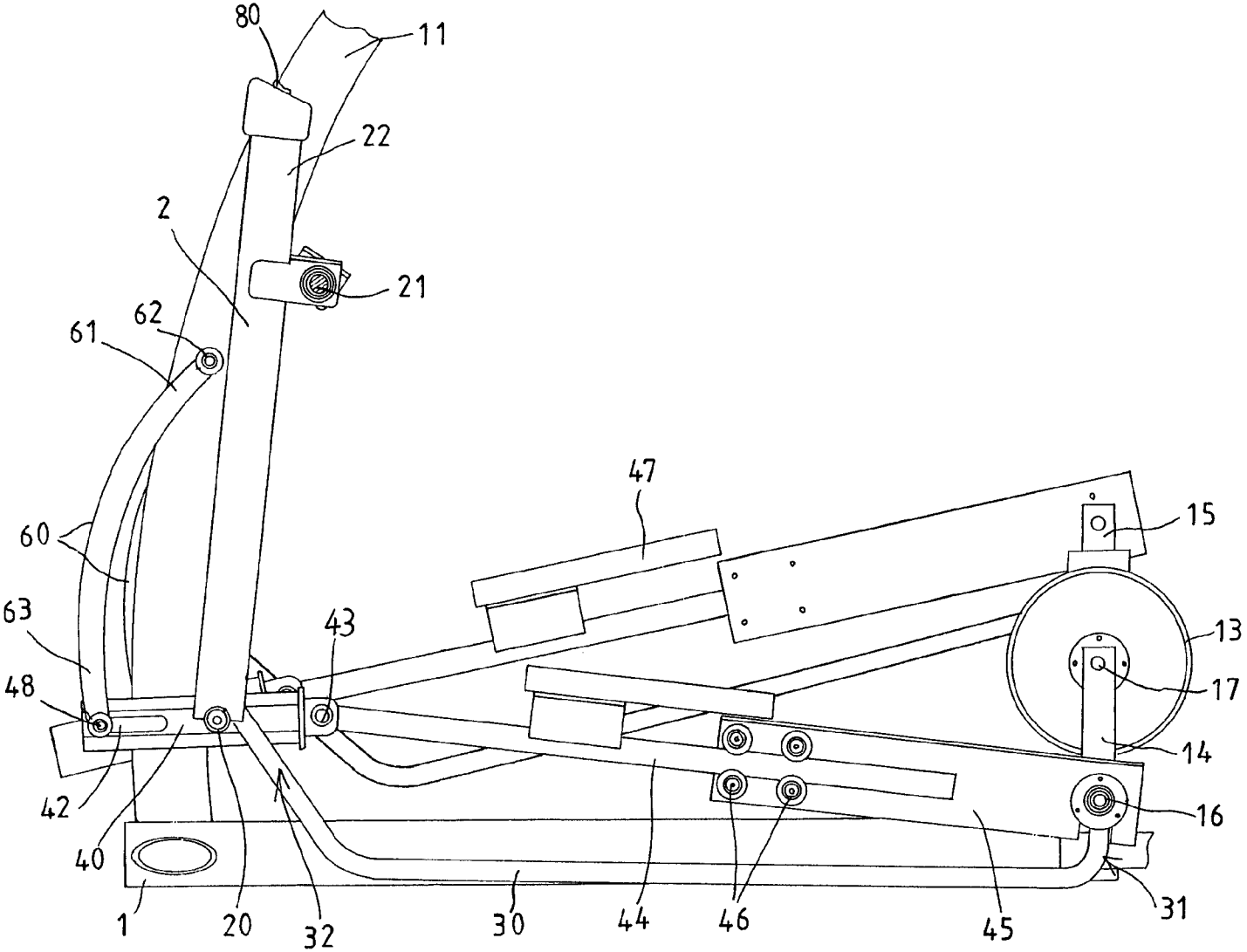
FIG. 2 is a side plan view of the stepping exerciser.
Figure 3:
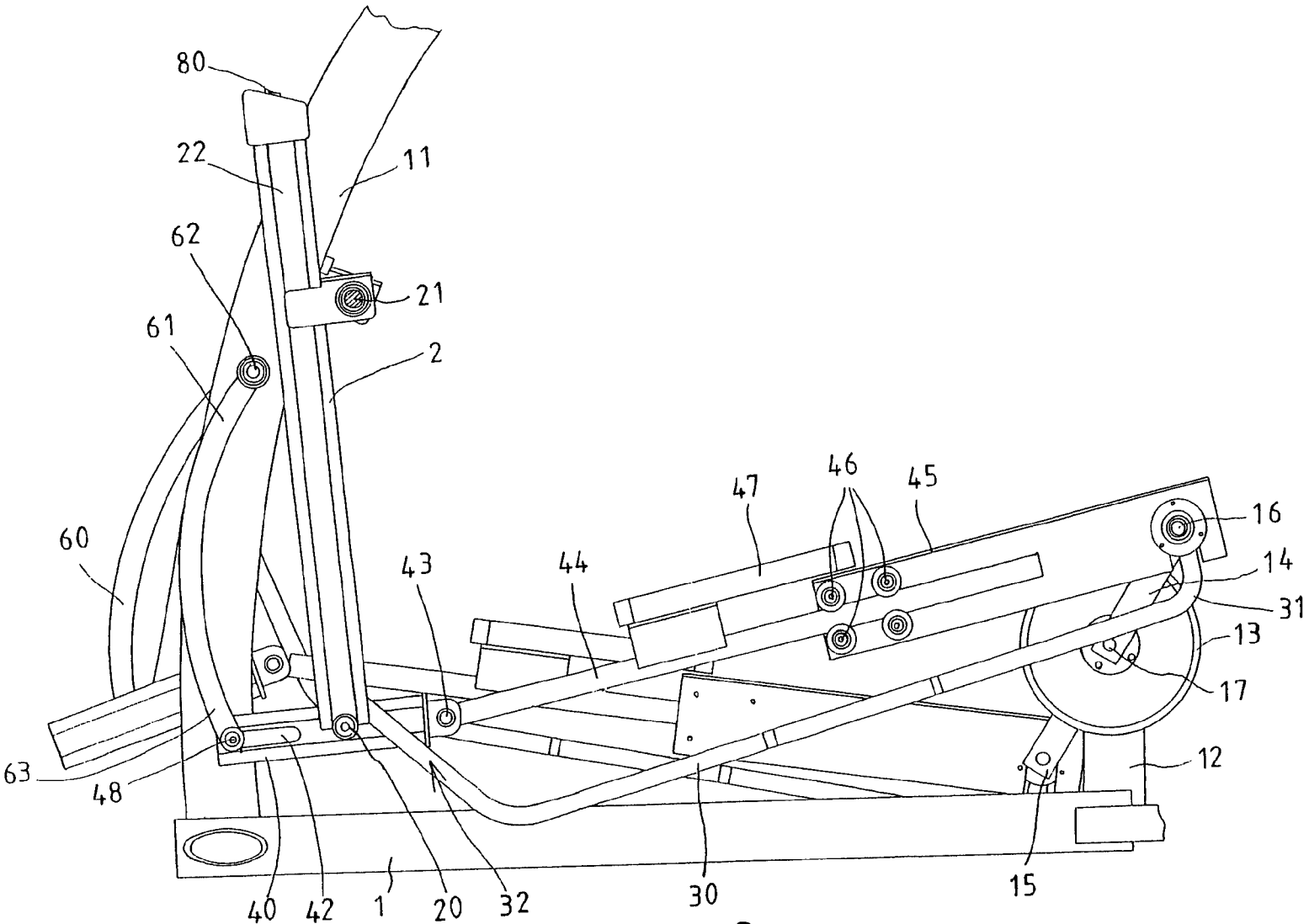
FIGS. 3, 4 are side plan views similar to FIG. 2, illustrating the operating of the stepping exerciser.
Figure 4:
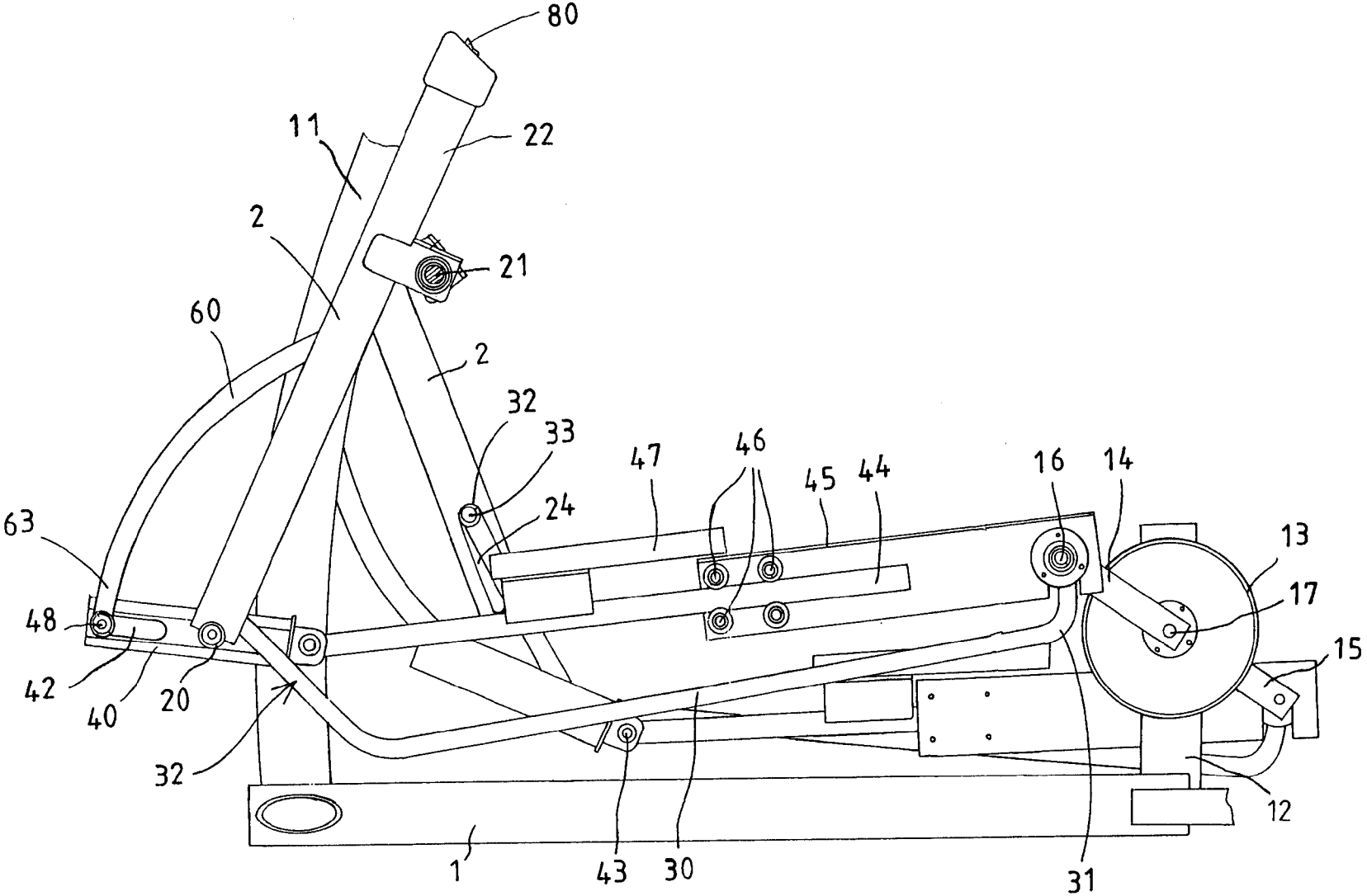

Referring to the drawings, and initially to FIGS. 1 and 2, a stepping exerciser in accordance with the present invention comprises a base 1 including a post 11 extended upwardly from or provided on the front portion thereof, and including a stay 12 extended upwardly from or provided on the rear portion thereof. A control box 10 or the like is disposed on top of the post 11 for controlling the operation of the exerciser.

A wheel 13 and a pair of cranks 14, 15 are rotatably secured or supported on the stay 12 with a pivot spindle 17, and rotated in concert with each other and rotatable relative to the base 1 with the pivot spindle 17. The cranks 14, 15 are extended away from each other as that for the typical cycling devices, and each includes a free end having an axle 16 attached thereto. The wheel 13 may be used as a resistive device to provide a resistive force against the operation of the exerciser.

As shown in FIG. 1, another wheel or weight 18 may further be provided and rotatably secured or supported on the rear portion of the base 1, and coupled to the wheel 13, and a brake device 19 may further be provided and disposed or located close to or beside the weight 18 for braking the weight 18, or for applying a brake force, such as a magnetic braking force against the weight 18, in order to provide a resistive force or a braking force against the movement or operation or actuation of the stepping exercisers.

A pair of bars 2 each has a middle or upper portion rotatably or pivotally or swingably secured to the upper portion of the post 11 with a shaft 21, and each includes a handle 22 formed or provided on top thereof, and each includes a hollow chamber 23 formed in the inner portion thereof (FIGS. 5, 6), and each includes one or more slots 24 formed in the middle or lower portion thereof, and located or provided below the shafts 21. Each of the bars 2 further includes a bottom end having a pivot pin 20 attached thereto or provided thereon.

A pair of links 30 each includes one end or rear portion 31 rotatably or pivotally secured to the free ends of the cranks 14, 15 with the axles 16 respectively, and each includes another end or front portion 32 for pivotally or rotatably and adjustably attached or secured to the respective bars 2, and for coupling the bars 2 and the cranks 14, 15 together. For example, the front portion 32 of the link 30 may be rotatably or pivotally secured to a shaft 33 that is slidably engaged in the slot 24 of each of the bars 2.

Figure 5:
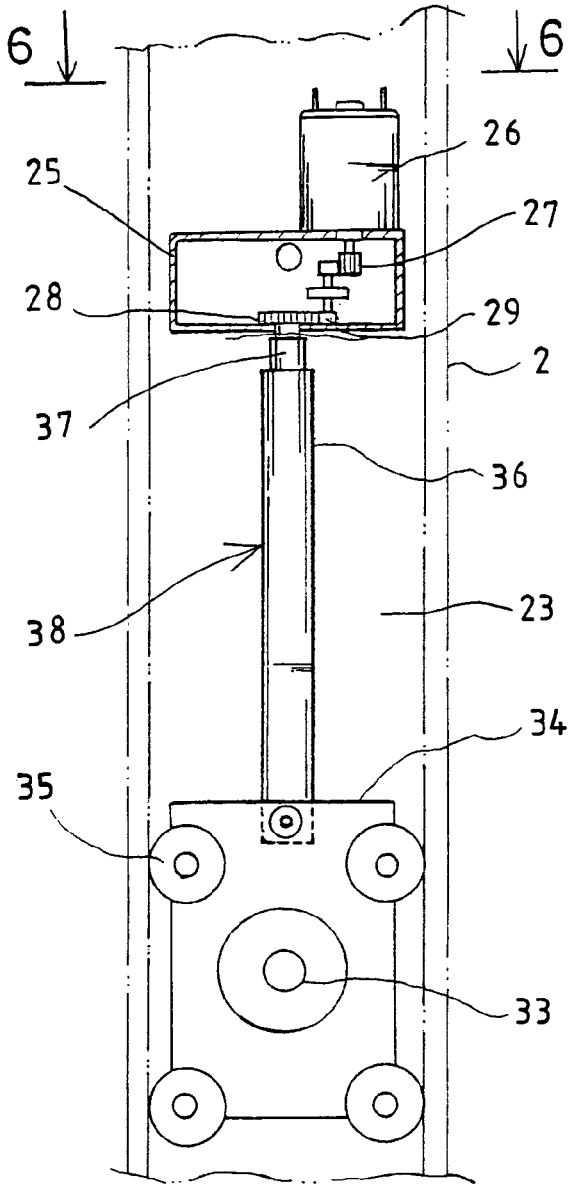
FIG. 5 is a partial cross sectional view taken along lines 5—5 of FIG. 1.
Figure 6:
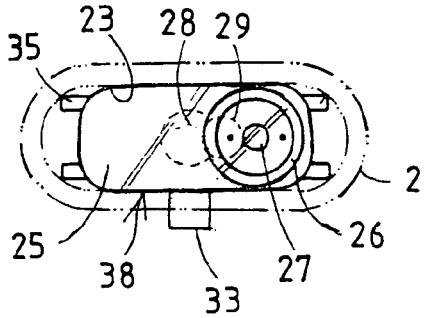
FIG. 6 is a partial cross sectional view taken along lines 6—6 of FIG. 5.

As shown in FIGS. 5 and 6, a slide 34 is slidably engaged in hollow chamber 23 of each of the bars 2 with such as one or more wheels or rollers 35, and includes the shaft 33 secured thereto or extended therefrom, for rotatably or pivotally secured to the front portion 32 of the link 30. A tube 36 includes one end or lower portion rotatably or pivotally secured to the slide 34 of each of the bars 2 respectively, and a bolt 37 threaded to the other end thereof, for allowing the tube 36 and thus the slide 34 to be moved and adjusted along the respective bars 2 by rotating the bolt 37 relative to the bars 2.

Each of the bars 2 further includes a casing 25 secured in hollow chamber 23 thereof, a motor 26 is attached or secured to each of the casings 25 and includes a pinion 27 extended into the casing 25. A gear 28 is rotatably received in the casing 25 and is secured to the bolt 37, and engaged with or coupled to the pinion 27 of the motor 26 with or via a reduction gearing device 29, to allow the gear 28 and thus the bolt 37 to be rotated or driven by the motor 26 via the pinion 27 and the reduction gearing device 29, and thus to allow the tube 36 and the slide 34 to be moved and adjusted along the respective bars 2 by the motor 26.

As shown in FIGS. 1 and 4–6, the front portions 32 of the links 30 are rotatably or pivotally secured to the shafts 33 that are slidably engaged in the slots 24 of the bars 2 respectively, and the shafts 33 and the slides 34 may be adjusted or moved relative to the bars 2 by the motors 26 and the bolts 37 respectively, such that the coupling between the cranks 14, 15 and the bars 2 may be adjusted by moving or adjusting the front portions 32 of the links 30 relative to the bars 2. The coupling and the adjustment of the front portions 32 of the links 30 relative to the bars 2 have been disclosed in applicant's prior U.S. Pat. No. 6,277,054 to Kuo and U.S. Pat. No. 6,620,079 to Kuo, which may be taken as references for the present invention.

Accordingly, the motors 26 and the bolts 37, and the tubes 36 and the slides 34 may thus be formed as an adjusting or moving means or device 38 for moving or adjusting the front portions 32 of the links 30 relative to the bars 2. However, it is to be noted that the front portions 32 of the links 30 may also be moved or adjusted relative to the bars 2 with the other adjusting means or devices 38, such as conventional pneumatic or hydraulic adjusting devices, gearing and/or tracking devices, sprocket-and-chain devices, pulley-and-belt devices, etc.

Figure 7:
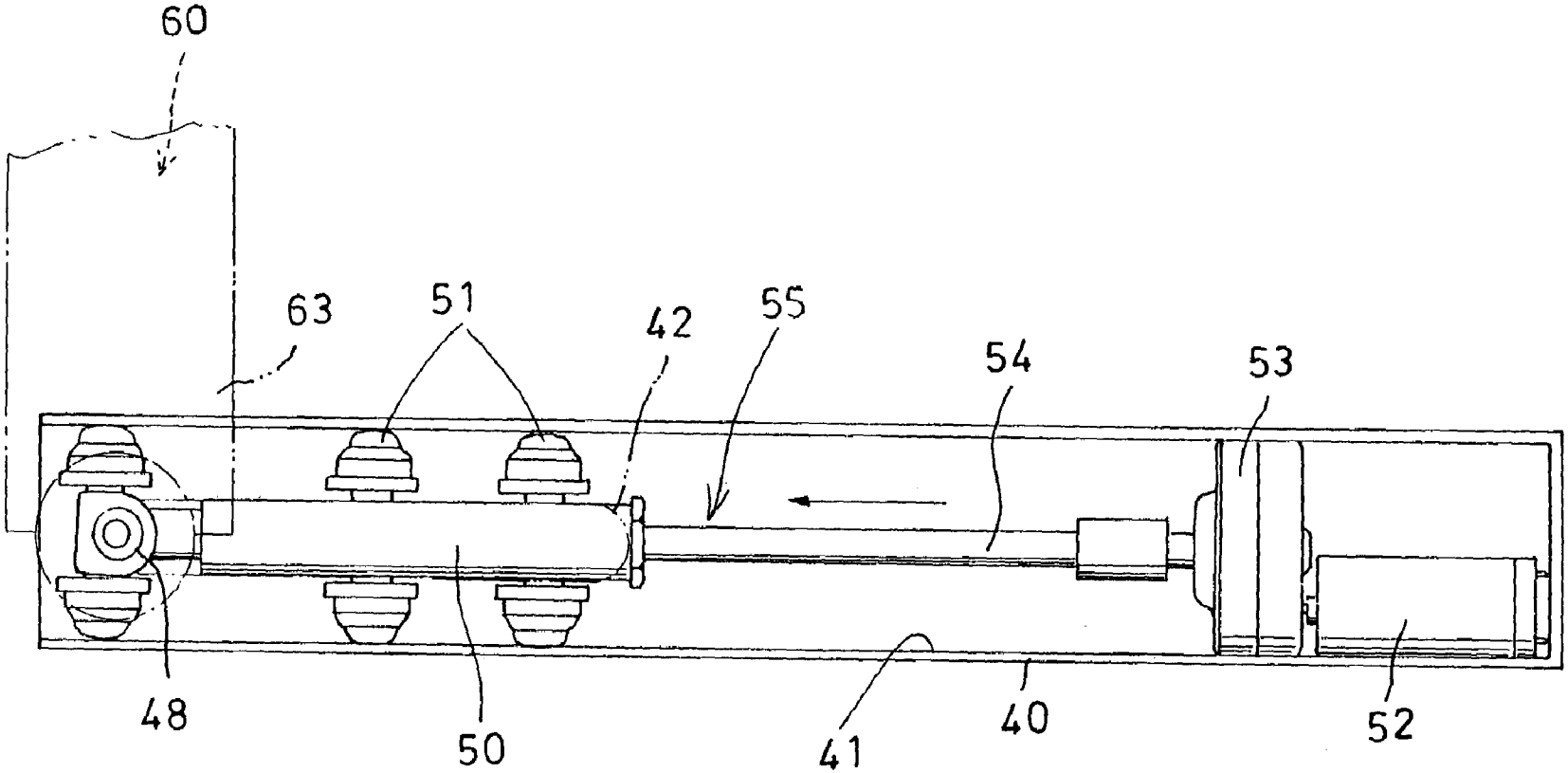
FIG. 7 is a partial cross sectional view taken along lines 7—7 of FIG. 1.
Figure 8:
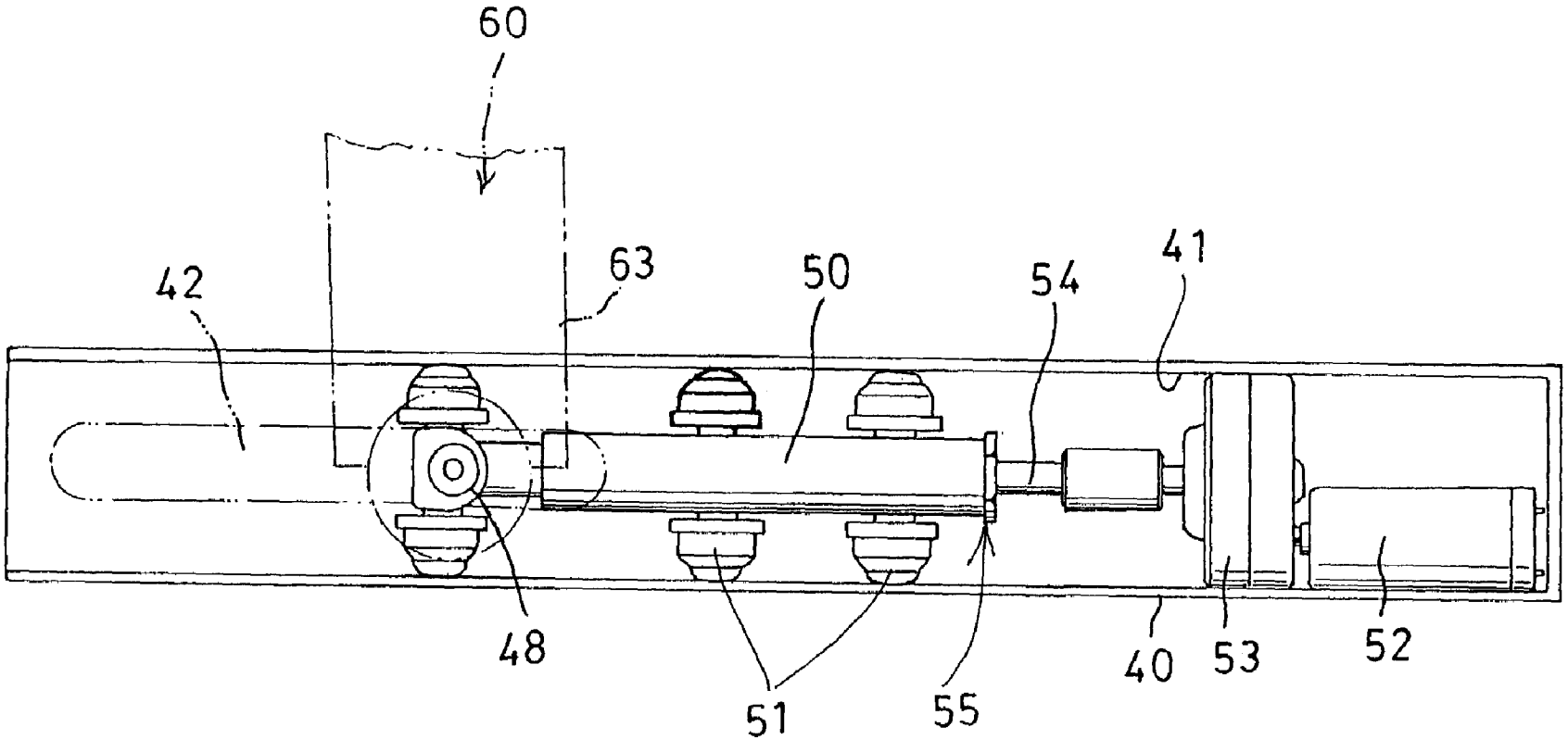
FIG. 8 is a partial cross sectional view similar to FIG. 7, illustrating the operating of the stepping exerciser.

A pair of beams 40 each includes a middle portion rotatably or pivotally secured to the lower portions of the bars 2 with the pivot pins 20 respectively, and each includes a hollow chamber 41 formed therein (FIGS. 7, 8), and each includes one or more slots 42 formed in the front portion thereof, and located or provided in front of the pivot pins 20 and communicating with the chamber 41 thereof. Each of the beams 40 may further include a rear portion having a pivot pin 43 attached thereto or provided thereon, for rotatably or pivotally securing or coupling a pole 44 thereto.

A pair of levers 45 each includes a rear portion rotatably or pivotally secured to the free ends of the cranks 14, 15 with the axles 16 respectively, and each includes one or more pairs of wheels or rollers 46 disposed therein, for slidably coupling the pole 44 thereto, and thus for allowing the poles 44 to be moved or slidably coupled to the levers 45 respectively. A pair of foot supports 47 may be provided or disposed on either the poles 44 or the levers 45 respectively, for supporting users thereon. Referring again to FIGS. 7 and 8, each of the beams 40 includes a pivot rod 48 slidably or movably engaged in and extended out of the slot 42 thereof respectively.

Each of the beams 40 includes a follower 50 slidably disposed in hollow chamber 41 thereof with one or more wheels or rollers 51, and coupled to the pivot rod 48 respectively. Each of the beams 40 further includes a motor 52 disposed in hollow chamber 41 thereof, and a reduction gearing device 53 also disposed in hollow chamber 41 thereof, and coupled to the motor 52, for being rotated or driven by the motor 52. A bolt 54 is secured or coupled to the reduction gearing device 53, and threaded with the follower 50, for allowing the bolt 54 to be rotated or driven by the motor 52 via the reduction gearing device 53, and thus to allow the follower 50 and the pivot rod 48 to be moved and adjusted along the respective beams 40 by the motor 52.

The motors 52 and the bolts 54, and the followers 50 and the pivot rods 48 may thus be formed as an adjusting means or device 55 for moving or adjusting the pivot rods 48 relative to the beams 40. However, it is to be noted that the pivot rods 48 may also be moved or adjusted relative to the beams 40 with the other moving or adjusting means or adjusting devices 55, such as conventional pneumatic or hydraulic adjusting devices, conventional gearing and/or tracking devices, sprocket-and-chain devices, pulley-and-belt devices, etc.

A pair of arms 60 may further be provided and each includes an upper portion 61 rotatably or pivotally secured to the upper or middle portions of the bars 2, 3 with pivot pins 62 respectively, and each includes a lower portion 63 rotatably or pivotally secured to the pivot rods 48 respectively. The lower portions 63 of the arms 60 and the pivot rods 48 may thus be moved and adjusted along the respective beams 40 by the motors 52, in order to adjust the coupling relation between the bars 2 and the beams 40 and the armd 60.

For example, when the lower portions 63 of the arms 60 and the pivot rods 48 are moved and adjusted toward or away from the pivot pins 20 or the bottom ends of the bars 2, the pivot pins 43 or the rear portions of the beams 40 may also be moved and adjusted upwardly or downwardly relative to the pivot pins 20 or the bottom ends of the bars 2, such that the coupling relation between the beams 40 and the poles 44 and the levers 45 may be adjusted, and such that the moving stride or the moving stroke of the foot supports 47 may also be adjusted.

A switch 70 may further be provided and disposed on top of one of the bars 2, such as disposed on top of the handle 22 of the bar 2, and is coupled to the motor 26, for operating or actuating the motor 26 to adjust the front portions 32 of the links 30 up and down relative to the bars 2, and thus to adjust the coupling between the cranks 14, 15 and the bars 2, in order to adjust the moving strides or moving strokes of the foot supports 47.

Another switch 80 may further be provided and disposed on top of the other bar 2, such as disposed on top of the handle 22 of the other bar 2, and is coupled to the other motor 52, for operating or actuating the motor 52 to adjust the lower portions 63 of the arms 60 toward or away from the pivot pins 20 or the bottom ends of the bars 2, and thus to adjust the coupling relation between the beams 40 and the poles 44 and the levers 45, in order to adjust the moving strides or moving strokes of the foot supports 47.

The brake device 19 or the braking operation of the wheel 13 may also be operated or actuated by either of the switches 70, 80, in order to provide an adjusting resistive force or braking force against the movement or operation or actuation of the stepping exerciser. The switches 70, 80 may be operated or actuated by the hands of the users that hold the upper portions of the handles 22 of the bars 2, to allow the moving strides or moving strokes of the foot supports 47 and the brake device 19 or the braking operation of the wheel 13 to be actuated or operated by the users while the users are operating the stepping exerciser, without stopping the exerciser.

Accordingly, the stepping exerciser in accordance with the present invention includes an adjustable mechanism for easily adjusting the moving stroke or the operation of the stepping exerciser while operating or actuating the stepping exerciser, without stopping the stepping exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion having a post extended upwardly therefrom, and including a rear portion, a pair of bars pivotally secured to said post, and each including an upper portion having a handle provided thereon for being grasped by the hands of users, and each including a lower portion, a wheel rotatably supported on said rear portion of said base, a pair of cranks coupled to said wheel and rotated in concert with said wheel, and each of said cranks including a free end, a pair of links pivotally coupled between said free ends of said cranks and said lower portions of said bars respectively, a pair of beams each including a middle portion pivotally secured to said lower portions of said bars with a pivot pin respectively, and each including a front portion having a pivot rod slidably attached thereto, and each including a rear portion, a pair of poles pivotally coupled to said rear portions of said beams respectively, a pair of levers each including a rear portion pivotally secured to said free ends of said cranks respectively, and said levers being slidably coupled to said poles respectively, to allow said poles to be moved and slid relative to said levers respectively, a pair of foot supports disposed on either said poles or said levers respectively, for supporting users thereon, a pair of arms each including an upper portion pivotally secured to said post respectively, and each including a lower portion pivotally secured to said front portions of said beams with said pivot rods respectively, to allow said lower portions of said arms to be moved and adjusted toward and away from said pivot pins respectively, and means for adjusting said lower portions of said arms toward and away from said pivot pins respectively, to adjust a coupling relation between said beams and said bars and said arms, and between said poles and said levers, in order to adjust a moving stroke of said foot supports.

2. The exerciser as claimed in claim 1, wherein said beams each includes a chamber formed therein, and each includes at least one slot formed therein and communicating with said chamber thereof, to slidably receive said pivot rods respectively, said pivot rods are extended out of said slots of said beams respectively.

3. The exerciser as claimed in claim 2, wherein said adjusting means includes a follower disposed in said chamber of each of said beams and coupled to said pivot rods respectively, a motor disposed in each of said beams and coupled to a bolt which is threaded with said follower, to allow said bolt to be rotated and driven by said motor, and to allow said follower and said pivot rod to be moved and adjusted along said beams by said motors.

4. The exerciser as claimed in claim 3, wherein said beams each includes a reduction gearing device coupled between said motor and said bolt.

5. The exerciser as claimed in claim 1, wherein said levers each includes at least one pair of rollers disposed therein, for slidably coupling said poles thereto, and to allow said poles to be slidably coupled to said levers respectively.

6. The exerciser as claimed in claim 1, wherein said links each includes one end pivotally coupled to said lower portions of said bars with a shaft respectively, and means for moving said shaft relative to said bars respectively.

7. The exerciser as claimed in claim 6, wherein said moving means includes a slide slidably engaged in each of said bars and having said pole secured thereto, for pivotally securing to said front portion of said link, a tube secured to each of said slides, a bolt threaded to each of said tubes, and a motor coupled to each of said bolts, to rotate and drive said bolts relative to said bars, and to adjust and to move said slides and said poles and said lower portions of said bars relative to said bars respectively.

8. The exerciser as claimed in claim 7, wherein each of said bars includes a casing disposed therein, a gear is rotatably received in said casing and is secured to said bolt, and said motor is attached to said casing and coupled to said gear, for rotating said gear and said bolt.

9. The exerciser as claimed in claim 6, wherein a switch is provided and disposed on top of one of said bars, to actuate said moving means.

10. The exerciser as claimed in claim 1, wherein said base includes a weight rotatably supported thereon.

11. The exerciser as claimed in claim 10, wherein said base includes a brake device disposed thereon, for braking said weight.

12. The exerciser as claimed in claim 1, wherein a switch is provided and disposed on top of one of said bars, to actuate said adjusting means.

* * * * *